US009856597B2

(12) United States Patent
Smoots

(10) Patent No.: US 9,856,597 B2
(45) Date of Patent: Jan. 2, 2018

(54) GLOVE AND MITTEN DRYER

(71) Applicant: Karen Smoots, Portage, MI (US)

(72) Inventor: Karen Smoots, Portage, MI (US)

( * ) Notice: Subject to any disclaimer, the term of this patent is extended or adjusted under 35 U.S.C. 154(b) by 299 days.

(21) Appl. No.: 14/590,791

(22) Filed: Jan. 6, 2015

(65) Prior Publication Data

US 2016/0090684 A1 Mar. 31, 2016

Related U.S. Application Data

(60) Provisional application No. 62/057,891, filed on Sep. 30, 2014.

(51) Int. Cl.

| | |
|---|---|
| ***F26B 25/00*** | (2006.01) |
| ***D06F 59/04*** | (2006.01) |
| ***F26B 21/00*** | (2006.01) |

(52) U.S. Cl.

CPC ..... *D06F 59/04* (2013.01); *F26B 21/008* (2013.01)

(58) Field of Classification Search

CPC ..... F26B 21/008; F26B 9/003; D06F 59/04; F16L 37/025; Y10T 29/4994; Y10T 24/3973; Y10T 29/49858; Y10T 29/49872; H04R 1/025; B60R 1/04; A47L 23/20; A47L 23/205; A43D 3/1491; B65D 77/003; B65D 85/62

USPC ..... 34/104; 403/52, 90, 83; 206/499, 500, 206/505

See application file for complete search history.

(56) References Cited

U.S. PATENT DOCUMENTS

| | | | | |
|---|---|---|---|---|
| 2,465,362 A * | 3/1949 | Elliott | A47L 23/20 | 206/216 |
| 3,413,021 A * | 11/1968 | Potts | F16L 37/025 | 285/319 |
| 4,398,633 A * | 8/1983 | Weinstein | B65D 85/62 | 206/436 |
| 4,435,031 A * | 3/1984 | Black | H01R 12/7029 | 174/138 D |
| 4,596,078 A * | 6/1986 | McCartney | A47L 23/205 | 34/103 |
| 6,327,792 B1 * | 12/2001 | Hebert | A43D 3/1491 | 34/104 |
| D665,549 S * | 8/2012 | Kropf | D32/58 | |
| 2005/0047850 A1 * | 3/2005 | Wright | H04R 1/025 | 403/90 |

* cited by examiner

*Primary Examiner* — Kenneth Rinehart
*Assistant Examiner* — Bao D Nguyen
(74) *Attorney, Agent, or Firm* — Ward Law Office LLC; Jacob M. Ward

(57) ABSTRACT

A drying system embodying a method and glove dryer mountable to an outlet of an already-running furnace when in use so as to safely and efficiently dry out articles, and that dissembles into stackable elements when stored is provided. The glove dryer may include a base providing a plurality of detachable nozzles. The base may form a volumetric enclosure for both safely mounting the outlet of an already-running furnace as well as for storage purposes. The plurality of detachable nozzles may be stacked in a nest configuration when removed from the base for storing in the volumetric enclosure. When in use, the plurality of detachable nozzles each provide a plurality of holes through which heated air from the outlet reaches to tops of articles of clothing slidably received thereon.

4 Claims, 4 Drawing Sheets

GLOVE AND MITTEN DRYER

CROSS-REFERENCE TO RELATED APPLICATION

This application claims the benefit of priority of U.S. provisional application No. 62/057,891, filed 30 Sep. 2014, the contents of which are herein incorporated by reference.

BACKGROUND OF THE INVENTION

The present invention relates to dryer devices and, more particularly, to a device mountable to an outlet of a furnace when in use so as to dry out articles, and that dissembles into stackable elements when stored.

Gloves, mittens, shoes and other articles of clothing are difficult to dry on the inside when sweat and moisture from snow, rain and perspiration saturate them. As such, this moisture and sweat cause foul odor and wet and cold extremities. Drying such articles is a costly process when utilizing gas or electric dryers as gloves, mittens and outdoor articles are designed to keep water from entering, and so when saturated they can take enormous amounts of energy to dry using the current systems. Current dryer systems for such articles not only require lengthy dry time and added electricity costs, they are also not portable or easily storable, and may be fire hazards if too makeshift.

As can be seen, there is a need for a device mountable to an outlet of an already-running furnace when in use so as to safely and efficiently dry out articles, and that dissembles into stackable elements when stored.

SUMMARY OF THE INVENTION

In one aspect of the present invention, a glove dryer for use with a preexisting furnace comprises: a base forming a volumetric enclosure for substantially enclosing an outlet of the preexisting furnace; a plurality of base holes provided by the base; and a plurality of tubular detachable nozzles, each comprising: a connecting end, wherein the connecting end is configured to removably attach to any one of the plurality of base holes; an opposing distal end, wherein the distal end forms a exit hole; and a plurality of auxiliary holes disposed between the connecting end and the distal end.

In another aspect of the present invention, a glove dryer for use with a preexisting furnace comprises: a base forming a volumetric enclosure for substantially enclosing an outlet of the preexisting furnace, wherein the volumetric enclosure is defined in part by a planar periphery, and a plurality of base holes provided by the base, wherein the plurality of base holes are arranged in a non-normal orientation with respect to the planar periphery; and a plurality of tubular detachable nozzles, each comprising: a connecting end, wherein the connecting end is configured to removably attach to any one of the plurality of base holes; an opposing distal end, wherein the distal end forms a exit hole; and a plurality of auxiliary holes disposed between the connecting end and the distal end, wherein each detachable nozzle tapers toward the distal end, wherein the plurality of detachable nozzles are dimensioned and configured to stack in a nested configuration, and wherein the volumetric enclosure is dimensioned to receive at least one nested configuration therein.

These and other features, aspects and advantages of the present invention will become better understood with reference to the following drawings, description and claims.

DETAILED DESCRIPTION OF THE INVENTION

Figure 1:
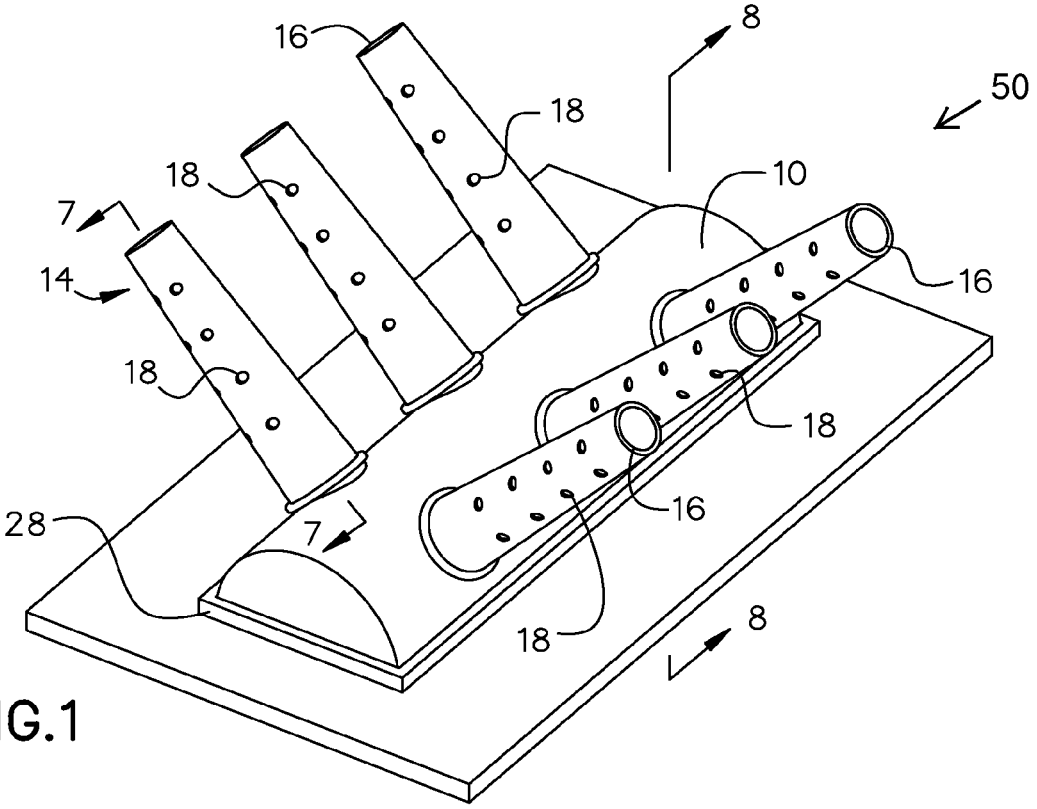
FIG. 1 is a perspective view of an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a drying system embodying a method and glove dryer mountable to an outlet of an already-running furnace when in use so as to safely and efficiently dry out articles, and that dissembles into stackable elements when stored. The glove dryer may include a base providing a plurality of detachable nozzles. The base may form a volumetric enclosure for both safely mounting the outlet of an already-running furnace as well as for storage purposes. The plurality of detachable nozzles may be stacked in a nest configuration when removed from the base for storing in the volumetric enclosure. When in use, the plurality of detachable nozzles each provide a plurality of holes through which heated air from the outlet reaches to tops of articles of clothing slidably received thereon.

Referring to FIGS. 1 through 10, the present invention may include a drying system embodying a method and a glove dryer 50 mountable to an outlet of an already-running furnace so as to safely and efficiently dry out articles when in use, and that dissembles into stackable elements when stored. The glove dryer 50 may include a base 10 and a plurality of detachable nozzles 14.

The base 10 may be substantially half-cylindrical shaped or may be configured in any volumetric shape so long as the base 10 function in accordance with the present invention as described herein. The half-cylindrical shape may be adapted to form a volumetric enclosure over an air register 28 so that the base 10 is not substantially resting directly on the air register 28 so as to mitigate overheating of the base 10 or otherwise stifling of the air register 28. In certain embodiments, the volumetric enclosure may be defined in part by a planar periphery 40 for circumscribing the air register 28.

The air register 28 may be a vent, a collection of vanes or the like that act to control the output of an outlet of a furnace. The volumetric shape of the base 10 may also facilitate sufficient spacing of the plurality of detachable nozzles 14, as illustrated in FIG. 1. The volumetric shape of the base 10 also enables the storage of the glove dryer 50 as discussed later.

The base 10 may have a plurality of base holes 12 arranged so as to facilitate sufficient spacing of the plurality of detachable nozzles 14. Each base hole 12 may be adapted to removably attach to a connecting end 34 of each detachable nozzle 14.

The detachable nozzle 14 may be a tapered tube that extends from the connecting end 34 to an opposing distal end terminating in an exit hole 16. The tapering shape of the detachable nozzle 14 facilitates slidably securing articles 30 onto the distal end thereof, as illustrate in FIG. 8. In certain embodiments, the volumetric shape of the base 10 has base holes 12 oriented at angles to support similarly-oriented nozzles 14 so that the article 30 can more readily rest thereon. In certain embodiments, the plurality of base holes may be arranged in a non-normal orientation with respect to the planar periphery 40 of the base 10. A plurality of auxiliary holes 18 may be arranged in a suitable manner on each detachable nozzle 14 between the connecting end 34 and the exit hole 16.

Figure 7:
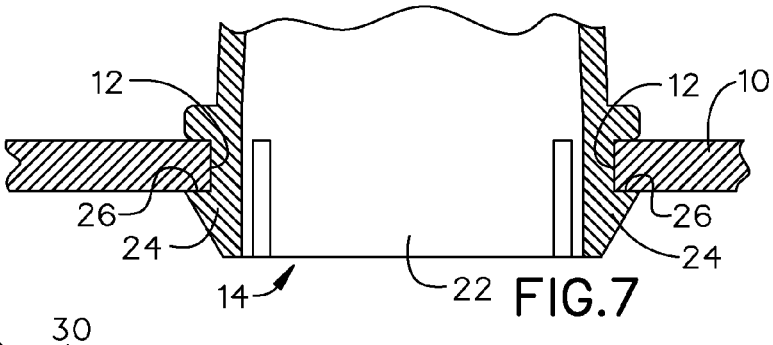
FIG. 7 is a detail section view of an exemplary embodiment of the present invention, taken along line 7-7 in FIG. 1.
Figure 8:
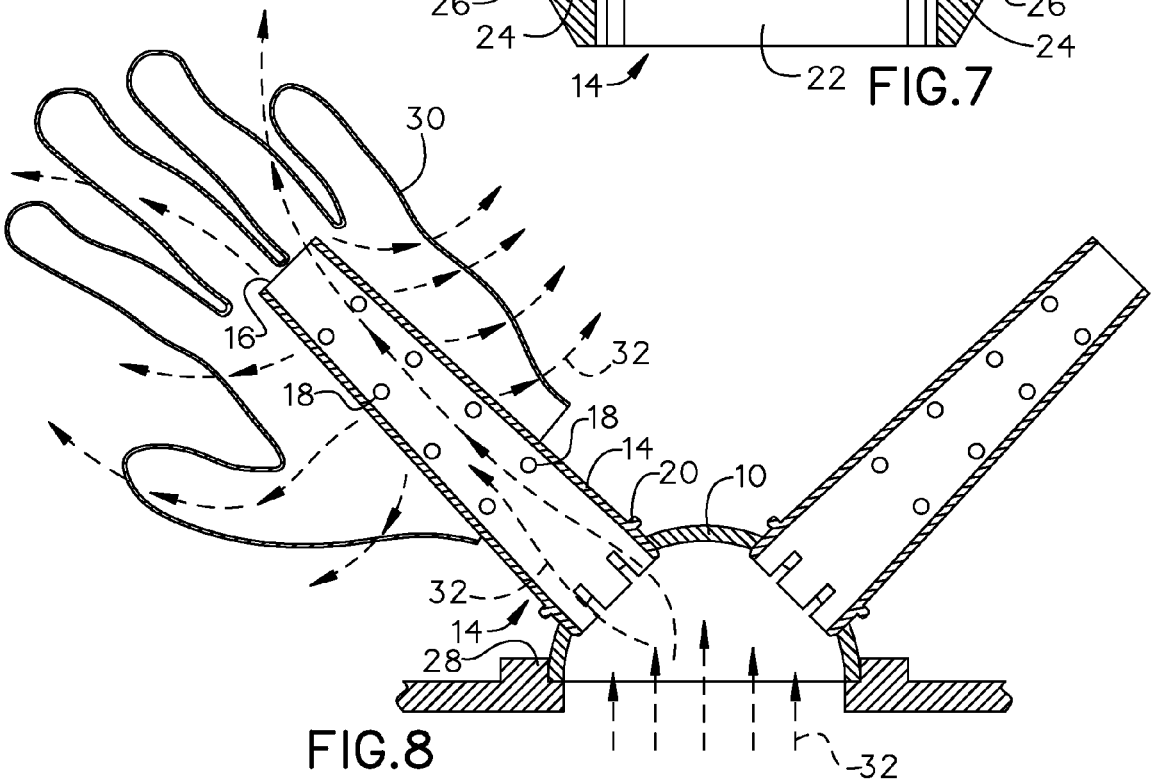
FIG. 8 is a section view of an exemplary embodiment of the present invention, taken along line 8-8 in FIG. 1, shown in use.
Figure 9:
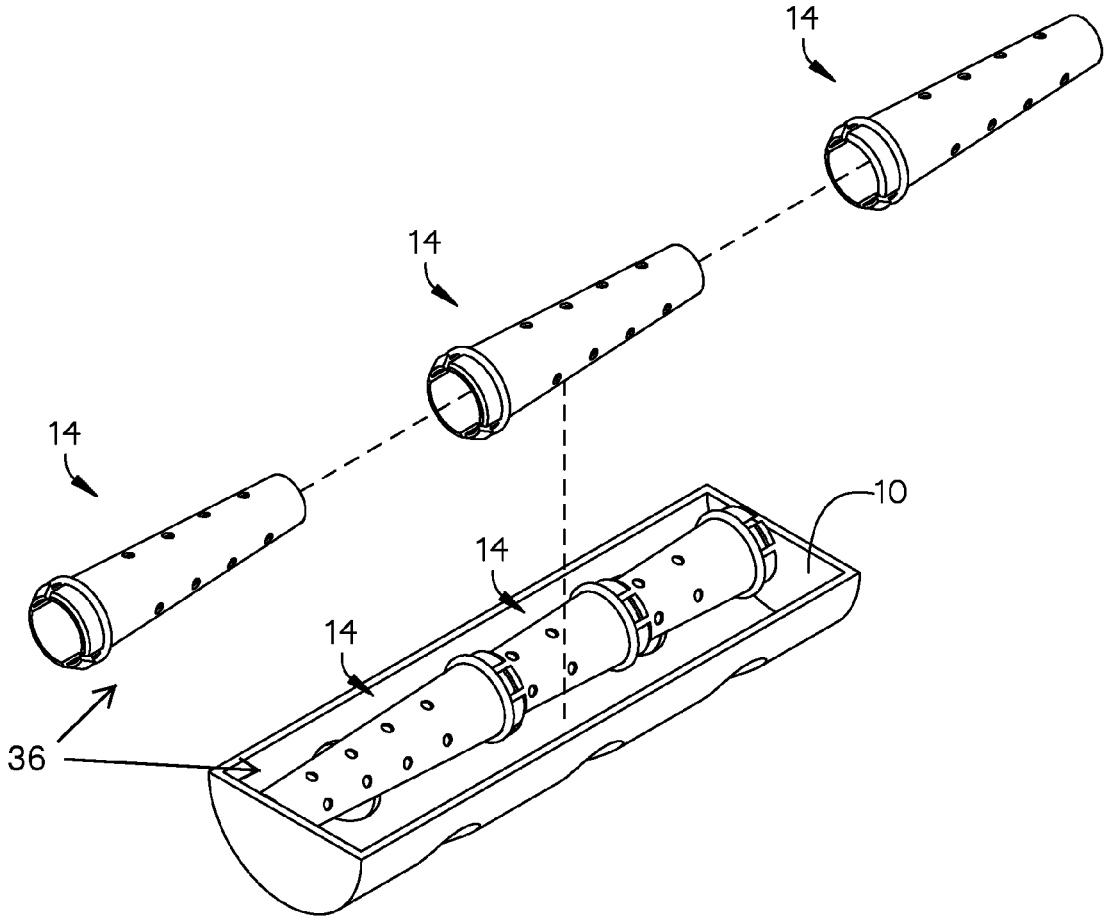
FIG. 9 is an exploded view of an exemplary embodiment of the present invention, demonstrating storage.
Figure 10:
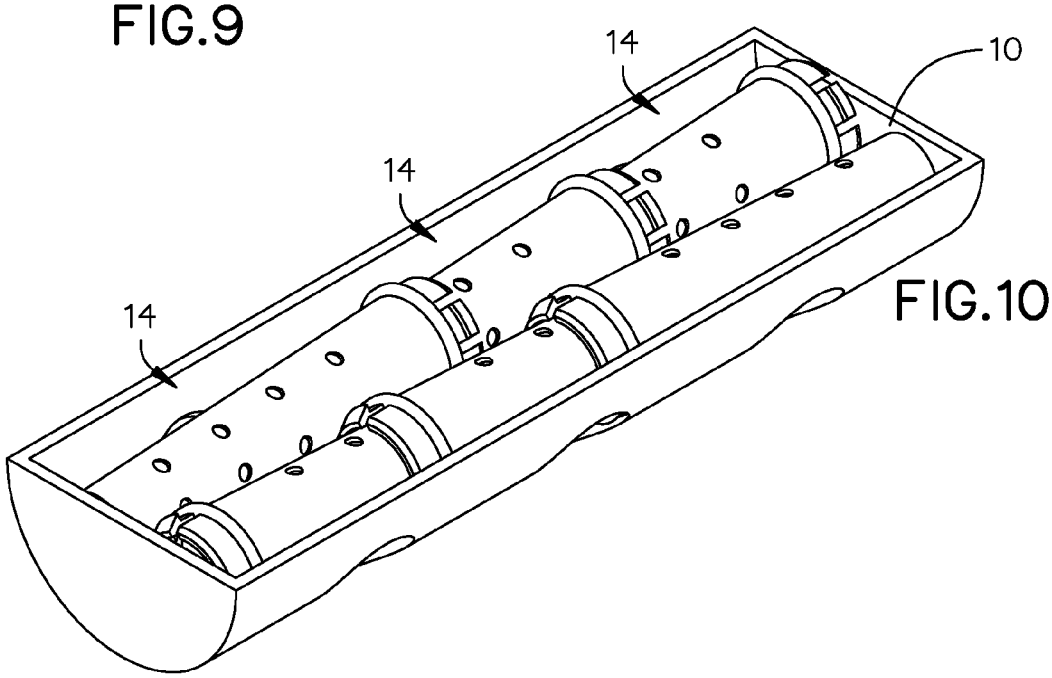
FIG. 10 is a perspective view of an exemplary embodiment of the present invention, demonstrating storage.

Each connecting end 34 may be dimensioned and adapted to be removably attached to a base hole 12. Each connecting end 34 may provide a stop rim 20 along a periphery of and inward from the connecting end 34. Each connecting end 34 may provide at least one guide rim 22 and at least one nozzle lock portion 24. Each nozzle locking portion 24 may provide a set-back clip portion 26 for removably locking the connecting end 22 to a periphery of a cooperating base hole 12, as illustrated in FIG. 7.

Each detachable nozzle 14 is stackable because of its tapered shape. In certain embodiments, the entire plurality of the detachable nozzle 14 may be stacked into at least one nested configuration 36 capable of being received by the volumetric enclosure of the base 10 for storage.

Figure 2:
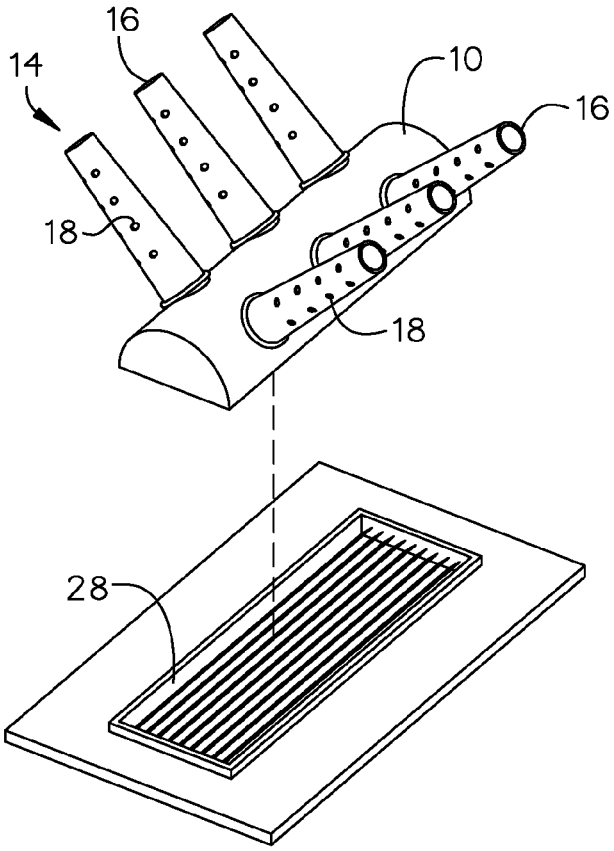
FIG. 2 is an exploded view of an exemplary embodiment of the present invention, shown in use.
Figure 3:
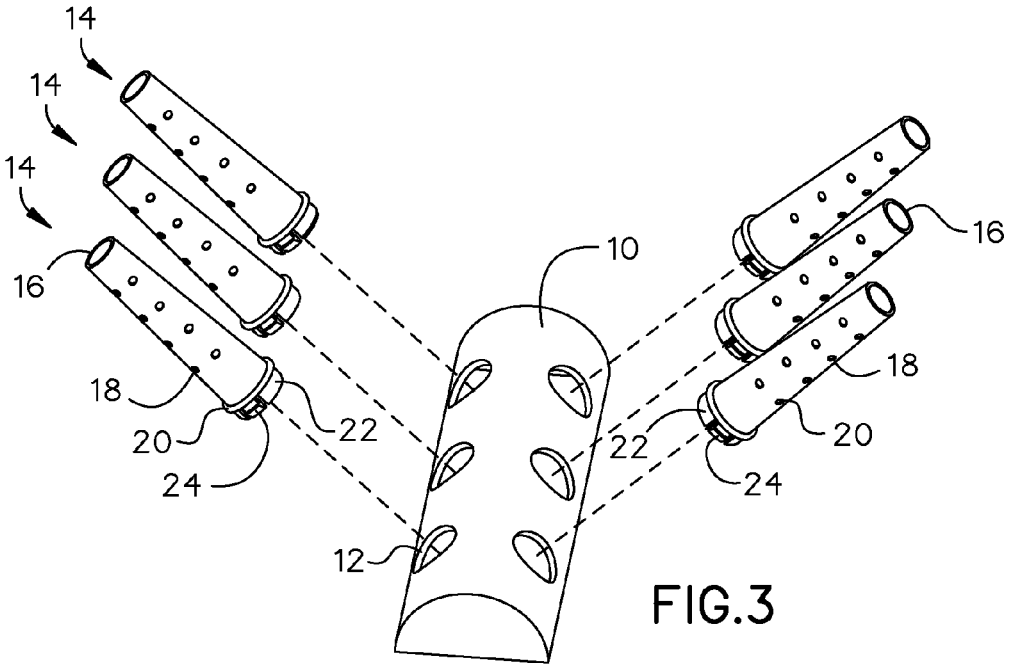
FIG. 3 is an exploded view of an exemplary embodiment of the present invention.
Figure 4:
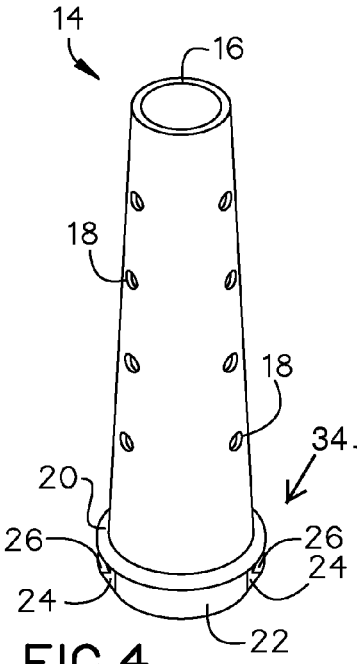
FIG. 4 is a top perspective view of an exemplary embodiment of the present invention.
Figure 5:
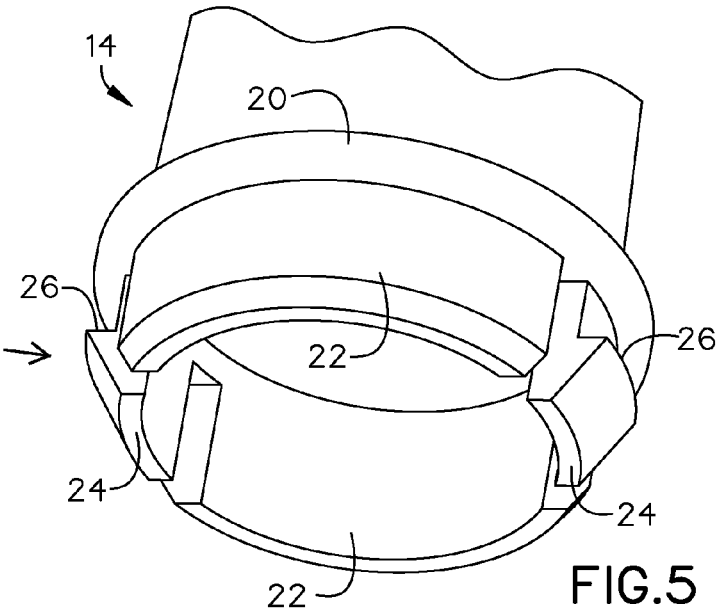
FIG. 5 is a bottom detail perspective view of an exemplary embodiment of the present invention.
Figure 6:
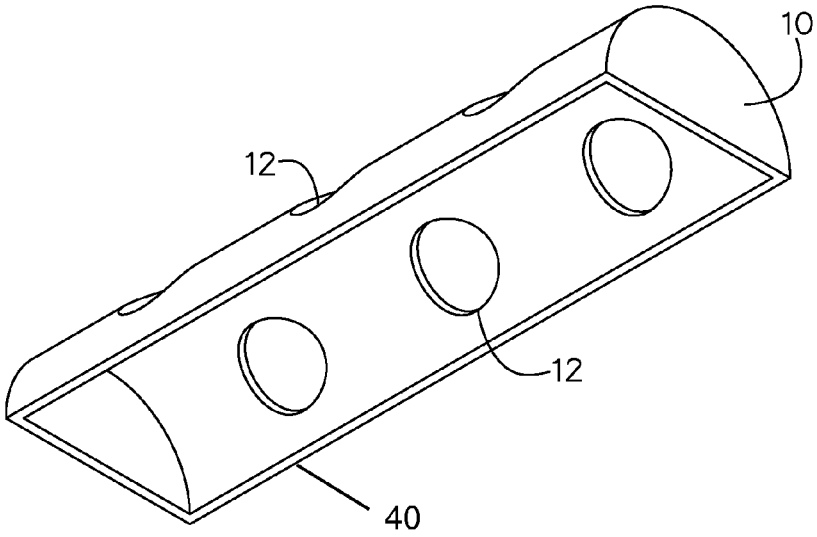
FIG. 6 is a bottom perspective view of an exemplary embodiment of the present invention.

A method of using the present invention may include the following. The glove dryer 50 disclosed above may be provided. A user may operably mount the base 10 over the air register 28, as illustrated in FIG. 2. Then the user may place a body-part-receiving opening of each article 30 over the distal end of a plurality of detachable nozzles 14, thereby allowing the heated air 32 through the plurality of auxiliary holes 18 and the exit hole 16 so as to reach to tops of the articles 30.

Subsequent use, the user may remove the plurality of detachable nozzles 14 and stack them into at least one nested configuration 36 for storing in the volumetric enclosure of the base 10 for later use.

It should be understood, of course, that the foregoing relates to exemplary embodiments of the invention and that modifications may be made without departing from the spirit and scope of the invention as set forth in the following claims.

What is claimed is:

1. A glove dryer for use with a preexisting furnace, the glove dryer comprising:

a base with a half-cylindrical shape and a planar periphery forming a volumetric enclosure configured to enclose an outlet of the preexisting furnace, the base having an arcuate wall disposed between a first end wall and a second end wall;

a plurality of base holes provided by the arcuate wall of the base; and a plurality of frustoconical tubular detachable nozzles, each of the nozzles consisting of:

a connecting end, wherein the connecting end is configured to removably attach to one of the plurality of base holes;

an opposing distal end, wherein each nozzle tapers toward the distal end, an outer diameter of the connecting end is larger than an outer diameter of the distal end, and the distal end forms an exit hole; and a plurality of auxiliary holes disposed between the connecting end and the distal end, wherein a diameter of the exit hole is larger than a diameter of each of the auxiliary holes;

a stop rim disposed along a periphery of the nozzle axially inwardly from the connecting end, the stop rim defined by a continuous ring disposed around the periphery, the continuous ring having an outer diameter greater than an outermost diameter of the periphery; and at least two guide rims and at least two set-back clip portions, the guide rims and the set-back clip portions spaced apart and alternating in an annular arrangement radially inwardly from the stop rim, and disposed between the stop rim and the connecting end, wherein each of the guide rims has a beveled surface, and each of the set-back clip portions is coupled to a nozzle lock portion having an angled outer surface and a planar surface that is oriented at an acute angle relative to the angled outer surface, the angled outer surfaces of the nozzle lock portions having a same orientation as the beveled surfaces of the guide rims, and a height of each of the beveled surfaces being less than a height of each of the angled outer surfaces, wherein a wall-receiving gap is defined by a distance between an underside of the stop rim and the planar surface of each of the nozzle lock portions, the distance being equal to a thickness of the arcuate wall of the base adjacent to the one of the plurality of base holes, whereby the wall-receiving gap is configured to securely receive the arcuate wall to removably lock the connecting end to the one of the plurality of base holes, and wherein a gap is defined by a distance between the underside of the stop rim and an upper surface of the arcuate wall of the base where the connecting end is attached to the one of the plurality of base holes.

2. The glove dryer of claim 1, wherein the plurality of detachable nozzles are dimensioned and configured to stack in a nested configuration.

3. The glove dryer of claim 2, wherein the volumetric enclosure is dimensioned to receive at least one nested configuration therein.

4. A kit for a glove dryer configured to be used with a preexisting furnace, the kit consisting of:

a base with a half-cylindrical shape and a planar periphery forming a volumetric enclosure configured to enclose an outlet of the preexisting furnace, the base having an arcuate wall disposed between a first end wall and a second end wall, the arcuate wall having a plurality of base holes formed therein;

a first plurality of nozzles stacked in a first nested configuration; and a second plurality of nozzles stacked in a second nested configuration, wherein each of the first plurality of nozzles and each of the second plurality of nozzles has a connecting end configured to removably attach to one of the base holes, an opposing distal end forming an exit hole, a plurality of auxiliary holes disposed between the connecting end and the distal end, a diameter of the exit hole being larger than a diameter of each of the auxiliary holes, a stop rim disposed along a periphery of the nozzle axially inwardly from the connecting end, the stop rim defined by a continuous ring disposed around the periphery, at least two guide rims and at least two set-back clip portions, the guide rims and the set-back clip portions spaced apart and alternating in an annular arrangement radially inwardly from the stop rim, and disposed between the stop rim and the connecting end, each of the guide rims having a beveled surface, and each of the set-back clip portions coupled to a nozzle lock portion having an angled outer surface and a planar surface that is oriented at an acute angle relative to the angled outer surface, the angled outer surfaces of the nozzle lock portions having a same orientation as the beveled surfaces of the guide rims, and a height of each of the beveled surfaces being less than a height of each of the angled outer surfaces, a wall-receiving gap defined by a distance between an underside of the stop rim and the planar surface of each of the nozzle lock portions, the distance being equal to a thickness of the wall of the base adjacent to the one of the base holes, whereby the wall-receiving gap is configured to securely receive the arcuate wall to removably lock the connecting end to the one of the base holes, and a gap defined by a distance between the underside of the stop rim and an upper surface of the wall of the base where the connecting end is attached to the one of the plurality of base holes, wherein each of the first plurality of nozzles and each of the second plurality of nozzles is tubular, frusto-conical, and tapers from the connecting end to the distal end, an outer diameter of the connecting end being larger than an outer diameter of the distal end, and wherein the first nested configuration and the second nested configuration are received by and removably disposed inside of the volumetric enclosure, the first nested configuration disposed adjacent to the second nested configuration between the first end wall and the second end wall, the distal ends of the first nested configuration facing the first end wall of the base, and the distal ends of the second nested configuration facing the second end wall of the base.

* * * * *